US006705413B1

(12) United States Patent
Tessari

(10) Patent No.: US 6,705,413 B1
(45) Date of Patent: Mar. 16, 2004

(54) DRILLING WITH CASING

(75) Inventor: Robert M. Tessari, Calgary (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 09/337,558

(22) Filed: Jun. 22, 1999

Related U.S. Application Data

(60) Provisional application No. 60/122,755, filed on Feb. 23, 1999.

(51) Int. Cl.[7] ..... E21B 11/00
(52) U.S. Cl. ..... 175/22; 175/73
(58) Field of Search ..... 175/22, 171, 61, 175/73, 74, 76

(56) References Cited

U.S. PATENT DOCUMENTS

| | | | | |
|---|---|---|---|---|
| 3,123,160 A | | 3/1964 | Kammerer | |
| 3,552,507 A | | 1/1971 | Brown | |
| 3,656,564 A | | 4/1972 | Brown | |
| 3,945,444 A | | 3/1976 | Knudson | |
| 4,501,337 A | * | 2/1985 | Dickinson, III et al. | 175/171 |
| 4,699,224 A | | 10/1987 | Burton | |
| 4,739,843 A | | 4/1988 | Burton | |
| 4,899,833 A | | 2/1990 | Warren | |
| 4,948,925 A | | 8/1990 | Winters | |
| 5,033,556 A | * | 7/1991 | Panzke | 175/62 |
| 5,103,919 A | | 4/1992 | Warren | |
| 5,186,265 A | | 2/1993 | Henson | |
| 5,194,859 A | | 3/1993 | Warren | |
| 5,197,553 A | | 3/1993 | Leturno | |
| 5,210,533 A | | 5/1993 | Summers | |
| 5,213,168 A | | 5/1993 | Warren | |
| 5,259,468 A | | 11/1993 | Warren | |
| 5,271,472 A | | 12/1993 | Leturno | |
| 5,423,389 A | | 6/1995 | Warren | |
| 5,547,031 A | | 8/1996 | Warren | |
| 5,582,259 A | | 12/1996 | Barr | |
| 5,601,151 A | | 2/1997 | Warren | |
| 5,845,722 A | | 12/1998 | Makohl et al. | |
| 6,059,051 A | * | 5/2000 | Jewkes et al. | 175/76 |
| 6,196,336 B1 | | 3/2001 | Fincher et al. | |

FOREIGN PATENT DOCUMENTS

| | | | | |
|---|---|---|---|---|
| EP | 530045 A | * | 3/1993 | 175/73 |
| EP | 571 045 | | 11/1993 | |

OTHER PUBLICATIONS

Warren, Tommy Trends Toward Rotary Steerable Directiona Systems. World Oil May 1997.

* cited by examiner

*Primary Examiner*—Thomas B. Will
*Assistant Examiner*—Meredith Petravick
(74) *Attorney, Agent, or Firm*—Carstens, Yee & Cahoon, L.L.P.

(57) ABSTRACT

A method and apparatus for drilling directional wellbores using a casing string as a drill stem is taught. A retrievable bit is mounted at an end of the casing string and either a mud motor with a bent housing and/or bent sub or a rotary steerable tool is used to direct the bit to drill directionally.

35 Claims, 3 Drawing Sheets

DRILLING WITH CASING

This application claims subject matter disclosed in prior filed provisional application serial No. 60/122,755, filed Feb. 23, 1999.

FIELD OF THE INVENTION

This invention is directed to well drilling and, in particular, to processes and devices for well drilling wherein a wellbore is advanced with a drill bit affixed to the distal end of a casing string.

BACKGROUND OF THE ART

The drilling of wells, for example, for oil and gas production conventionally employs relatively small diameter strings of drill pipe to which is secured a drill bit of somewhat larger diameter. After a selected portion of the wellbore has been drilled, the well bore is usually lined with a string of tubulars known as casing. The casing (herein used to encompass any wellbore liner) has a larger diameter than drill pipe and a smaller diameter than the drill bit. This conventional system which requires sequentially drilling the borehole using drill pipe with a drill bit attached thereto, pulling the drill pipe out of the borehole and running casing into the borehole is time consuming and costly. In addition, control of the well is difficult during the period that the drill pipe is being removed and the casing is being run in.

Drilling with casing is gaining popularity as a method for drilling wherein the casing is used as the drilling conduit and, after drilling, the casing remains downhole to act as the wellbore liner. A drilling assembly, including a drill bit and one or more hole enlargement tool such as, for example, an underreamer, is used which drills a borehole of sufficient diameter to accommodate the casing. The drilling assembly is deployed on the advancing end of the casing. The drill bit can be retractable and/or removable through the casing.

Casing drilling has been tested for drilling vertical, straight wellbores. However, new techniques for reservoir management require the drilling of curved, directional boreholes. This technique is commonly termed directional drilling or horizontal drilling, where a well bore close to horizontal is formed, and can be used to create boreholes having radii of curvature ranging from tens, hundreds or thousands of feet. Various techniques have been developed for drilling directional boreholes including the use of whipstocks.

Of particular importance in directional drilling are rotary steerable tools or downhole motors equipped with bent housings and/or bent subs which permit control of forces acting perpendicular to the drill string to steer the drill bit in a selected direction while drilling. To date, directional drilling systems have been developed for use with conventional drill pipe. No system is currently available for drilling directional boreholes using casing. This causes drillers to resort to the conventional system of first drilling the borehole and then, separately, lining it. When directional drilling, companies must accept the increased cost, time and hazard of separately drilling and then lining a borehole.

SUMMARY OF THE INVENTION

A method and apparatus for drilling directional boreholes using casing has been invented. The present invention provides a method and apparatus for drilling a directional borehole wherein the drill string is formed of casing which can be left in place after drilling is complete to act as the borehole liner. By utilizing casing as both the drilling conduit and the wellbore liner, the expensive and hazardous drill string insertion and retrieval operations are minimized.

In accordance with a broad aspect of the present invention, there is provided an apparatus for drilling a wellbore in an earth formation comprising: a drill string having a longitudinal bore therethrough; a drilling assembly connected at the lower end of the drill string and selected to be retrievable through the longitudinal bore of the drill string; and a directional borehole drilling assembly connected to the drill string and including biasing means for applying a force to the drill bit to drive it laterally relative to the wellbore.

The drill string useful in the present invention must have a longitudinal bore of sufficient inner diameter and be of a form suitable to act as a wellbore liner. In one embodiment, the drill string is casing.

At the lower end of the casing is mounted a drilling assembly selected to be operable to form a borehole having a diameter greater than the diameter of the casing while including a portion which is retrievable through the longitudinal bore of the drill string to provide for removal of the portion without removing the drill string of casing. The drilling assembly can be mountable to the casing in any suitable way, for example, by toothed engaging pads, corresponding locking dogs or latches, packers or other means. The drilling assembly can be any suitable assembly for drilling a borehole including, for example, rotary bits, impact bits or laser technology. In one embodiment, the bit assembly includes a primary bit and a hole enlargement tool. The hole enlargement tool or tools is/are positioned to enlarge the wellbore behind the primary bit. In one embodiment, the hole enlargement tool is one or more underreamers. To permit retrieval of the drilling assembly including underreamers, they can be radially retractable and extendable. The underreamers can be extendable in various ways, such as for example by pivotal movement or by sliding movement. Another drilling assembly useful in the present invention is a bicentre bit which does not have retractable underreamers but instead has an eccentric cutter positioned so that the drilling assembly can be shifted within the inner diameter of the drill string to permit it to be retrieved through the longitudinal bore of the drill string.

The bit assembly can be suitable for use in rotary drilling, wherein rotation is imparted to the drill bit by rotation of the drill string, for example, from surface. Alternately, the drilling assembly can be suitable for use in motor drilling wherein the drill bit is driven to rotate by a downhole drive unit such as a Moineau-type motor, a vane motor, a turbine motor or an electric motor.

A directional borehole drilling assembly useful in the present invention includes biasing means for applying a force to the drill bit to drive it laterally relative to the wellbore. In one aspect of the invention, the directional borehole drilling assembly is useful in motor drilling and, in another aspect, the directional borehole drilling assembly is useful with a rotary drilling system. The biasing means can be any suitable means for deflecting the drill bit to drill a curved borehole.

In one embodiment for use in motor drilling, the biasing means is a bent sub or a bent housing. The bent sub and bent housing each have an upper section and a lower section and a connector disposed between the upper section and the lower section to attach the upper section to the lower section, the connector being selected to provide for the lower section to be out of axial alignment with the upper section. The connector can be any suitable means including, for example, a bent section in a mud motor housing, a bent pipe section, a flexible joint or any other connector for mounting the lower section such that its longitudinal axis can be offset from the longitudinal axis of the upper section. The upper section can be a section of the drill string or another section such as, for example a tube section of any desired length. The lower section is any desired member such as, for example, a drill collar, a cross-over sub, formation evaluation tools or a section of drill string of any desired length. In a bent housing, the upper section and the lower section are often sections of the mud motor housing. Outer collars, eccentric members, razor backs and/or other directional drilling means can be mounted on the upper section, lower section, bit or casing, as desired.

In an embodiment for use in rotary drilling, wherein rotation is imparted to the drill string in order to effect borehole formation, the biasing means can be, for example, a fulcrum assembly such as an eccentric member positioned about the drill string, a hydraulic or non-hydraulic modulated biasing means or a drilling fluid jetting system.

A hydraulic or non-hydraulic modulated biasing means has moveable thrust members or pads which are displaceable outwardly at the same selected rotational position in the wellbore during each rotational cycle of the drill string to bias the drilling assembly laterally and, thereby, to control the direction of drilling.

In a drilling fluid jetting system, the biasing means is a jet of fluid discharged under the control of a valving system. The valving system controls the discharge of drilling fluid into the borehole either in a evenly distributed manner, to drill straight, or into a selected sector of the borehole during each rotational cycle of the drill string when it is desirable to divert the drill bit to drill in another direction.

Where desired, at least a portion of the directional borehole drilling assembly is retrievable through the drill string. In particular, the bit, the upper section and the lower section can be sized and/or formed to be retrievable through the drill string separately or as a unitary member.

In accordance with another broad aspect of the present invention, there is provided a method for directionally drilling a well with a well casing as an elongated tubular drill string and a drilling assembly retrievable from the lower distal end of the drill string without withdrawing the drill string from a wellbore being formed by the drilling assembly, the method comprising: providing the casing as the drill string; providing a directional borehole drilling assembly connected to the drill string and including biasing means for applying a force to the drilling assembly to drive it laterally relative to the wellbore; providing a drilling assembly connected at the distal end of the drill string and being retrievable through the longitudinal bore of the drill string; inserting the drill string, the directional borehole drilling assembly and the bit assembly into the wellbore and driving the bit assembly to rotate for cutting the wellbore to a diameter greater than the diameter of the drill string; operating the biasing means to drive the drilling assembly laterally relative to the wellbore; removing the bit assembly from the distal end of the drill sting upon completion of the wellbore without removing the drill string from the wellbore; and leaving the drill string in the wellbore to serve as the casing for the well.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
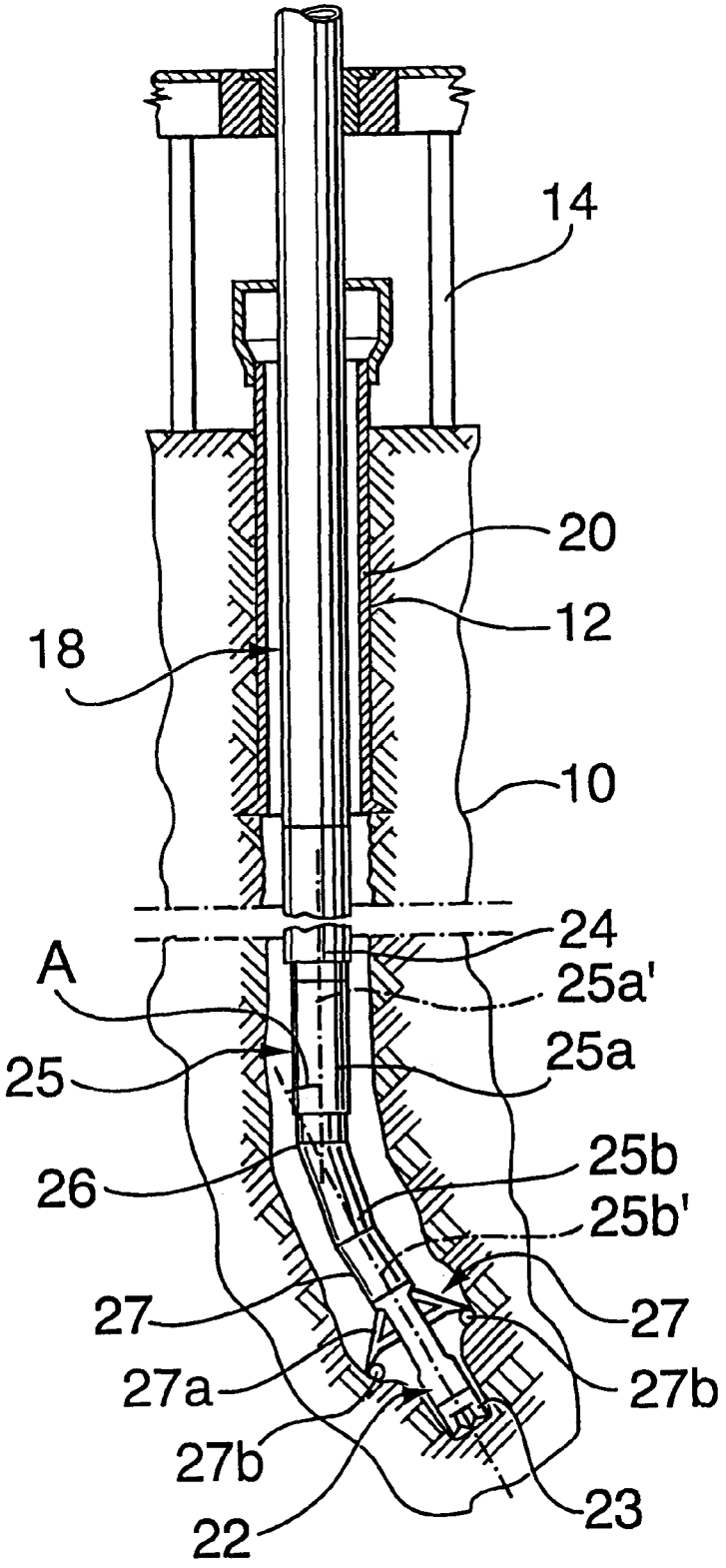
FIG. 1 is a vertical section, in somewhat schematic form, of a wellbore being drilled by a method and using an apparatus according to one aspect of the present invention.

The drawing figures that follow are not necessarily to scale, and certain features are shown in generalized form in the interests of clarity.

FIG. 1 refers to an embodiment using a mud motor having a bent housing. There is illustrated an earth formation 10 into which a wellbore 12 is being formed by a casing drilling assembly and using a method in accordance with the present invention. Wellbore 12 is formed by a rig 14 (only shown in part) including a top drive (not shown) and a casing string, generally indicated at 18. Casing string 18 is made up of joints of pipe threaded together end to end using, for example, conventional casing threads or high strength threads. Wellbore 12 is shown with a larger diameter casing string 20 cemented to the earth formation 10. The smaller diameter casing string 18 extends through casing string 20 and is used for drilling the wellbore.

Wellbore 12 is being formed in accordance with the present invention by a bit assembly 22 and a mud motor 25 connected at the lower end 24 of casing string 18. Bit assembly 22 is driven to rotate by mud motor 25. The mud motor is preferably a progressive cavity pump, as is known. Mud motor 25 has a bent housing including an upper portion 25*a* having an axis 25*a*' and a lower portion 25*b* having an axis 25*b*'. The housing upper portion is set out of axial alignment with the lower portion by a bend 26 formed in the motor housing. The angle of the bend, and therefore the deviation A of axis 25*a*' from axis 25*b*', is selected to be typically up to about 40°. This degree of deviation determines the radius of borehole curvature which will be drilled using the mud motor. A larger angle of deflection causing a shorter radius of curvature in the borehole.

In particular, the axial deviation of lower portion 25*b* relative to upper portion 25*a* causes the bit assembly to be biased to drill a curved borehole section in the direction of axis 25*b*'. The direction of the resulting wellbore 12 can be directed by slightly rotating the casing string 18 while drilling using the top drive. The orientation and direction of the casing is measured by a conventional measurement while drilling (MWD) device in the bit assembly 22.

Bit assembly 22 and mud motor 25 are releasably mounted at the lower end of the casing string by an expandable/retractable packer (not shown) mounted on upper portion 25*a* of the mud motor housing. Bit assembly 22 and mud motor 25 are adapted and sized to be retrievable from wellbore 12 through the interior of casing string 18, without removing casing string 18 from the wellbore. Retrieval of the bit assembly and the motor is by a wireline carrying a retrieval tool. The retrieval tool acts to latch onto the upper portion of motor housing and manipulates the motor such that the packer is retracted from engagement against the casing interior.

Bit assembly 22 includes a pilot bit 23 and an underreaming assembly 27. Pilot bit 23 can be, for example, a tri cone, polycrystalline diamond compact (PDC) or any other type of bit for use in drilling wellbores. Pilot bit 23 is trailed by underreaming assembly 27 which serves to enlarge the wellbore to a diameter larger than the outer diameter of casing string 18 so as to allow the casing string to advance into the earth formation. Underreaming assembly 27 includes arms 27*a* carrying cutters 27*b*. Arms 27*a* are pivotally retractable and expandable. Thus, arms 27*a* can be retracted to permit bit assembly 22 to be passed down through the interior of casing string 18. Upon reaching the bottom of the casing string, the arms can be expanded to permit hole enlargement behind the pilot bit. The arms are again retractable to permit the bit assembly to be retrieved to surface through the casing interior for maintenance, replacement or other operations.

Figure 2:
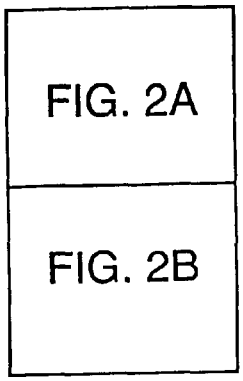
FIG. 2 shows the orientation of FIGS. 2A and 2B.
Figure 2A:
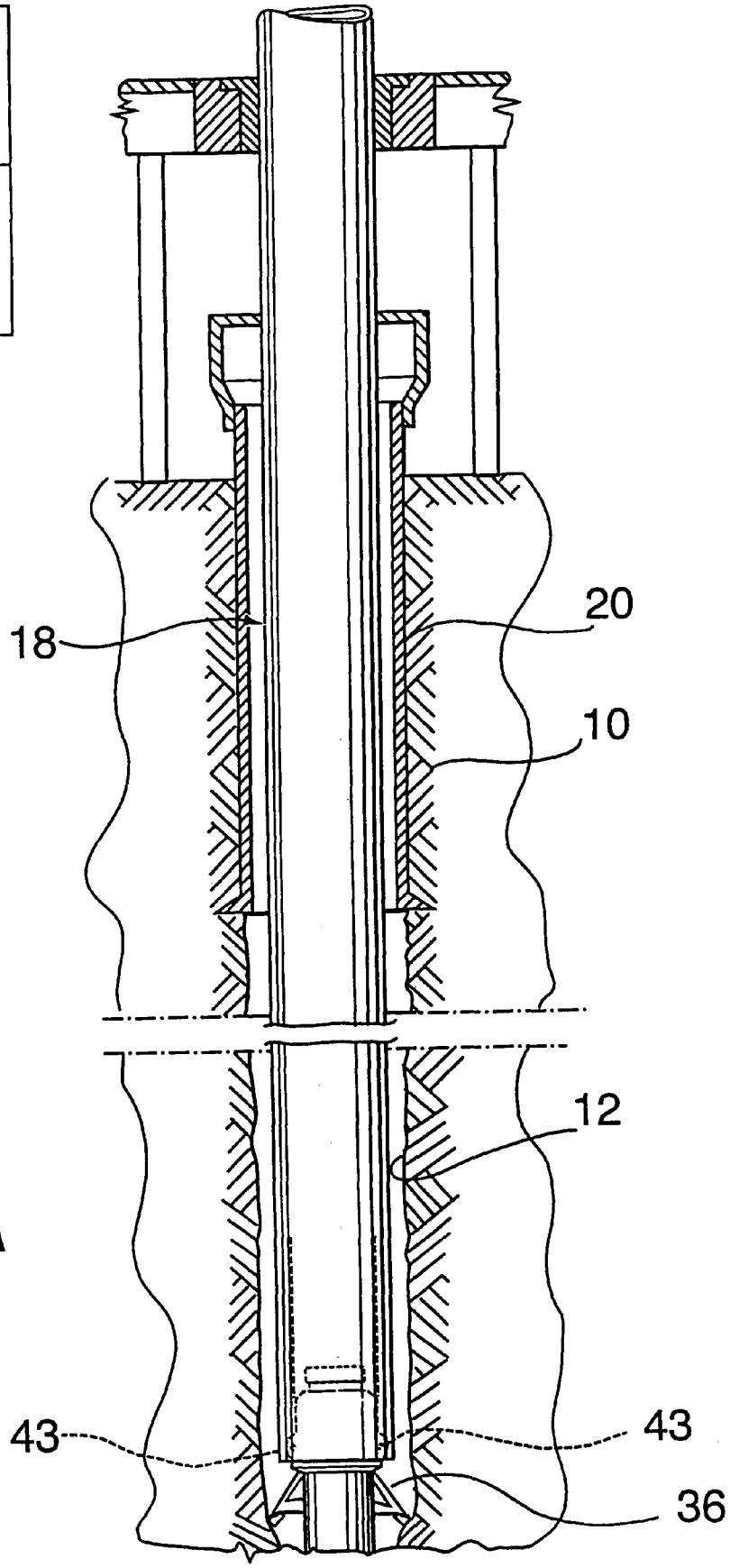
FIGS. 2A and 2B are the upper and lower parts, respectively, of a vertical section, in somewhat schematic form, of a wellbore being drilled by a method and using an apparatus according to another aspect of the present invention.
Figure 2B:
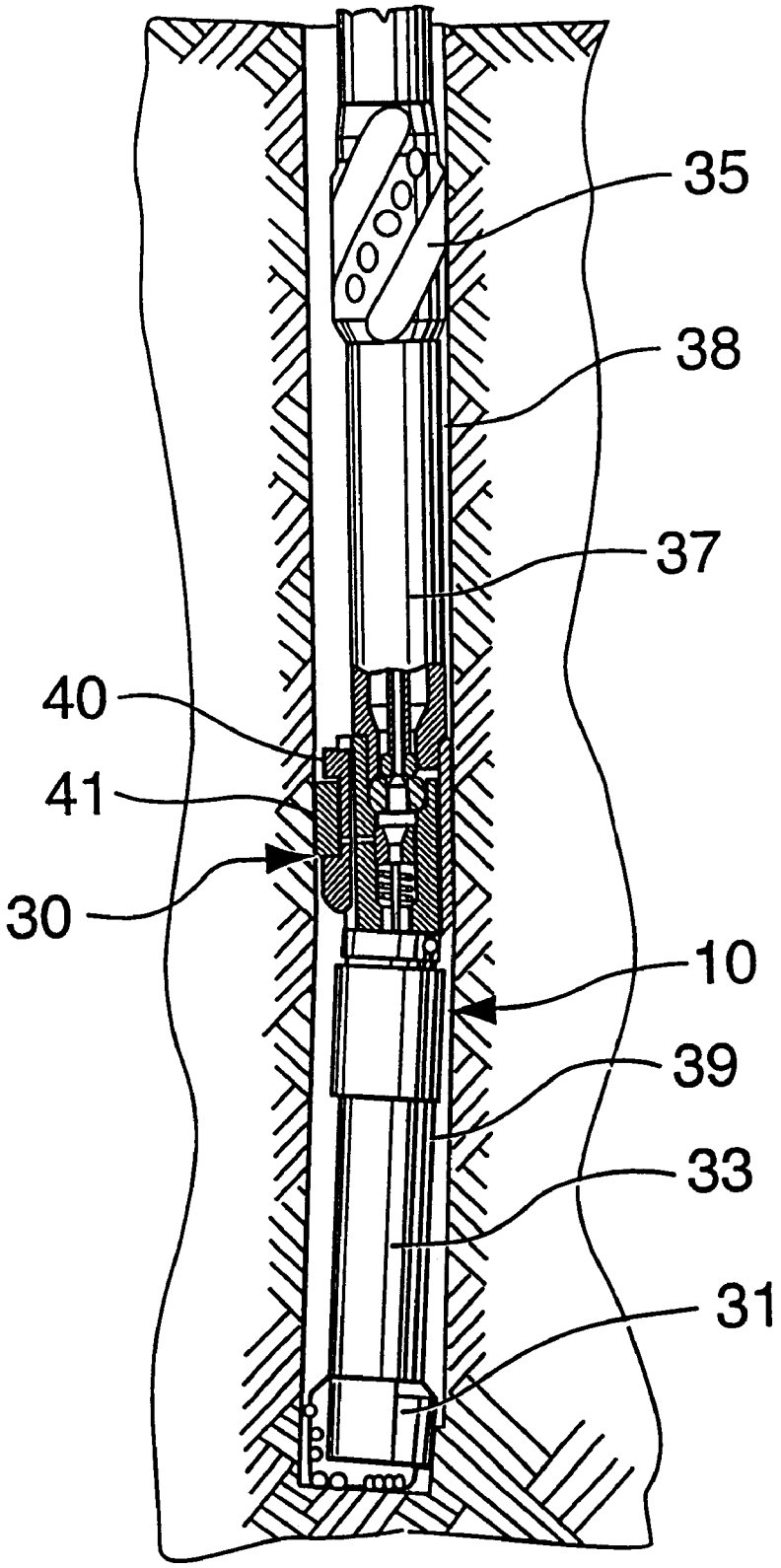

FIGS. 2A and 2B detail an embodiment of the present invention, wherein the casing is rotated, for example, by a top drive in order to cause the bit assembly to rotate to effect drilling. In this embodiment, directional drilling is achieved using a rotary steerable tool (RST) generally represented at 30. A bit 31 is attached at the lower end of RST 30. Bit 31 can any one of several types including, for example, a PDC or tri cone. In the illustrated embodiment, bit 31 is attached to the lower end of RST 30 by a MWD tool 33, although a short length of pipe or other connectors can alternately be used. An underreaming assembly 36 is mounted above RST 30. Underreaming assembly 36 is substantially similar to that assembly described in relation to FIG. 1.

The RST includes a top section 38 and a bottom section 39 and disposed therebetween a ball type joint 37, which allows the bottom section 39 to flex out of axial alignment with top section 38. Ball type joint 37 is modified so that axial rotational force can be transferred therethrough from top section 38 to bottom section 39. The RST further includes an eccentric sleeve 40 mounted on lower section and disposed to be rotatable thereabout. Eccentric sleeve 40 includes a guiding blade 41 biased outwardly from the surface of the eccentric sleeve. Guiding blade 41 acts as a razor back and is disposed to pressingly engage against the side of the wellbore when the RST is disposed in a wellbore. RST 30 is rigidly engaged at lower end of casing string 18 to be rotatable therewith. When the top section of the RST is driven to rotate in a wellbore, eccentric sleeve 40 remains in a fixed position in the wellbore substantially without rotation due to engagement of guiding blade 41 against wellbore wall while the top and bottom sections rotate freely within the eccentric sleeve.

Above the RST is a centralizer 35 for maintaining the top of the RST in the centre of the borehole. Eccentric sleeve 40 forms a fulcrum along the drill string which causes top section 38 and bottom section 39 to flex about ball type joint 37 and out of axial alignment with each other. Thus, the RST provides for drilling of a curved wellbore in the direction corresponding to the direction of the axis of bottom section 39.

Underreaming assembly 36 is releasably latched to the lower end of casing 18 through a dog and stop mechanism, generally indicated at 43. There are two series of dogs, one for stopping the passage of the underreaming assembly through the casing and another for acting as a torque lock. The torque lock dogs extend radially and engage into slots that have been machined into the interior of the bottom joint of casing 18*a*. The torque lock dogs securely latch underreaming assembly 36 to the casing to ensure that they rotate in unison.

Underreaming assembly 36, centralizer 35, RST 30 and bit 31 are connected together and are sized and configured to be recoverable through casing string 18 using wireline, or other means such as coiled tubing, and a retrieval tool which latches onto the upper end of underreaming assembly 36. Retrieval of the connected tools may be required to permit maintenance or replacement of components of the tools or to remove the tools from the well when drilling is complete. In particular, upon completion of the wellbore 12, if the casing string 18 is to serve as the liner or casing, the connected tools 36, 35, 30 and 31 are retrieved through the casing 18 and the casing is left in the wellbore. The wellbore can then be completed or treated in any desired way. Sometimes when casing drilling it is decided, after drilling, to abandon the wellbore or to leave it in an unlined state. In such an instance, although the connected tools 36, 35, 30 and 31 are capable of being retrieved through the casing string and may have been retrieved and replaced many times during the drilling operation, the casing string will be removed from the wellbore after drilling and, therefore, it is not necessary to retrieve the tools through the casing since they can be raised to surface with the casing string.

Although preferred embodiments of the present invention have been described in some detail hereinabove, those skilled in the art will recognise that various substitutions and modifications may be made to the invention without departing from the scope and spirit of the appended claims.

The embodiments of the invention in which an exclusive property or privilege is claimed are defined as follows:

1. A method for directionally drilling a well with a well casing as an elongated tubular drill string and a drilling assembly retrievable from the lower distal end of the drill string without withdrawing the drill string from a wellbore being formed by the drilling assembly, the method comprising: providing the casing as the drill string; providing a drilling assembly connected at the distal end of the drill string and being retrievable through the longitudinal bore of the drill string, the drilling assembly including a primary bit and a hole enlargement tool; providing a directional borehole drilling assembly connected to the drilling assembly and positioned to act in the well bore below the drill string and including biasing means for applying a force to the drilling assembly to drive it laterally relative to the wellbore, the directional borehole drilling assembly being at least in part retrievable from the wellbore through the longitudinal bore of the drill string; inserting the drill string, the directional borehole drilling assembly and the drilling assembly into the wellbore and driving the drilling assembly to operate to form a wellbore to a diameter greater than the diameter of the drill string; operating the biasing means to drive the drilling assembly laterally relative to the wellbore; removing at least the primary bit and the hole enlargement tool of the drilling assembly from the distal end of the drill string and moving the at least the primary bit and the hole enlargement tool of the drilling assembly with at least a part of the directional borehole drilling assembly connected thereto out of the wellbore through the drill string without removing the drill string from the wellbore; and leaving the drill string in the wellbore.

2. The method of claim 1 wherein after moving the at least the primary bit and the hole enlargement tool of the drilling assembly with at least a part of the directional borehole drilling assembly connected thereto out of the wellbore through the drill string, the method further comprises: replacing the at least the primary bit and the hole enlargement tool of the drilling assembly on the distal end of the drill string and operating the drilling assembly to continue formation of the wellbore.

3. The method of claim 2 further comprising replacing the at least a part of the directional borehole drilling assembly when replacing the at least the primary bit and the hole enlargement tool.

4. The method of claim 1 wherein the hole enlargement tool is an underreamer including radially expandable and retractable underreamer arms and the method comprises retracting the underreamer arms prior to moving the drilling assembly through the drill string.

5. An apparatus for drilling a wellbore in an earth formation comprising: a drill string having a longitudinal bore therethrough; a drilling assembly connected at the lower end of the drill string, the drilling assembly selected to be operable to form a borehole and including a primary bit and a hole enlargement tool, the hole enlargement tool acting to enlarge the wellbore diameter behind the primary bit and the primary bit and the hole enlargement tool being retrievable through the longitudinal bore of the drill string; and a directional borehole drilling assembly connected to the drilling assembly and including biasing means for applying a force to the drilling assembly selected to drive it laterally relative to the wellbore, the directional borehole drilling assembly selected at least in part to be retrievable through the longitudinal bore of the drill string.

6. The apparatus for drilling a wellbore of claim 5 wherein the hole enlargement tool is extendable and retractable relative to the primary bit.

7. The apparatus for drilling a wellbore of claim 5 wherein the directional borehole drilling assembly includes at least one of (a) a bent sub and (b) a bent housing.

8. The apparatus for drilling a wellbore of claim 5 wherein the directional borehole drilling assembly includes a modulated biasing means for forcing the drilling assembly away from one side of the borehole wall.

9. The apparatus for drilling a wellbore of claim 5 wherein the primary bit and the hole enlargement tool are driven by a downhole motor.

10. The apparatus for drilling a wellbore of claim 5 wherein the directional borehole drilling assembly is a rotary steerable tool and the rotary steerable tool is positioned between the primary bit and the hole enlargement tool.

11. The apparatus for drilling a wellbore of claim 5 wherein the directional borehole drilling assembly is a bent sub and the bent sub is positioned between the lower end of the drill string and the hole enlargement tool.

12. The apparatus for drilling a wellbore of claim 5 wherein the directional borehole drilling assembly is a bent motor housing and the bent motor housing is positioned between the lower end of the drill string and the hole enlargement tool.

13. The apparatus for drilling a wellbore of claim 5 wherein the primary bit and the hole enlargement tool are replaceable on the lower end of the drill string by running through the longitudinal bore of the drill string and once replaced are operable with the drill string to continue to form a borehole.

14. The apparatus for drilling a wellbore of claim 13 wherein the directional borehole drilling assembly is selected at least in part to be replaceable through the longitudinal bore of the drill string.

15. A method for directionally drilling a well with a well casing as an elongated tubular drill string and a drilling assembly retrievable from the lower distal end of the drill string without withdrawing the drill string from a wellbore being formed by the drilling assembly connected at the distal end of the drill string and being retrievable through the longitudinal bore of the drill string, the drill string including a primary bit and a hole enlargement tool, the method comprising: providing a directional borehole drilling assembly connected to the drilling assembly, the directional borehole drilling assembly including a rotary steerable tool for applying a force to the drilling assembly to drive it laterally relative to the wellbore, the directional borehole drilling assembly being positioned to act in the wellbore below the drill string and between the primary bit and the hole enlargement tool and being at least in part retrievable from the wellbore through the longitudinal bore of the drill string; inserting the drill string, the directional borehole drilling assembly and the drilling assembly into the wellbore and driving the drilling assembly to operate to form a wellbore to a diameter greater than the diameter of the drill string; operating the rotary steerable tool to drive the drilling assembly laterally relative to the wellbore; removing at least a portion of the drilling assembly from the distal end of the drill string and moving the at least a portion of the drilling assembly with at least a part of the directional borehole drilling assembly connected thereto out of the wellbore through the drill string without removing the drill string from the wellbore; and leaving the drill string in the wellbore.

16. The method of claim 15 wherein after moving the at least the primary bit and the hole enlargement tool of the drilling assembly with at least a part of the directional borehole drilling assembly connected thereto out of the wellbore through the drill string, the method further comprises replacing the at least the primary bit and the hole enlargement tool of the drilling assembly on the distal end of the drill string and operating the drilling assembly to continue formation of the wellbore.

17. The method of claim 16 further comprising replacing the at least a part of the directional borehole drilling assembly when replacing the at least the primary bit and the hole enlargement tool.

18. An apparatus for drilling a wellbore in an earth formation composing: a drill string having a longitudinal bore therethrough; a drilling assembly connected at the lower end of the drill string, the drilling assembly selected to be operable to form a borehole and at least in part to be retrievable through the longitudinal bore of the drill string and including a primary bit and a hole enlargement tool, the hole enlargement tool acting to enlarge the wellbore diameter behind the primary bit; and a directional borehole drilling assembly connected between the primary bit and the hole enlargement tool and including a rotary steerable tool for applying a force to the drilling assembly to drive it laterally relative to the wellbore, the directional borehole drilling assembly selected at least in part to be retrievable through the longitudinal bore of the drill string.

19. The apparatus for drilling a wellbore of claim 18 wherein the hole enlargement tool is extendable and retractable relative to the primary bit.

20. The apparatus for drilling a wellbore of claim 18 wherein the primary bit and the hole enlargement tool are replaceable on the lower end of the drill string by running through the longitudinal bore of the drill string and once replaced are operable with the drill string to continue to form a borehole.

21. The apparatus for drilling a wellbore of claim 20 wherein the directional borehole drilling assembly is selected at least in part to be replaceable through the longitudinal bore of the drill string.

22. A method for directionally drilling a well with a well casing as an elongated tubular drill string and a drilling assembly retrievable from the lower distal end of the drill string without withdrawing the drill string from a wellbore being formed by the drilling assembly, the method comprising: providing the casing as the drill string; providing a drilling assembly connected at the distal end of the drill string and being retrievable through the longitudinal bore of the drill string, the drill string including a primary bit and a hole enlargement tool; providing a directional borehole drilling assembly connected to the drilling assembly, the directional borehole drilling assembly including a rotary steerable tool for applying a force to the drilling assembly to drive it laterally relative to the wellbore, the directional borehole drilling assembly being positioned to act in the wellbore below the drill string and between the primary bit and the hole enlargement tool and being at least in part retrievable from the wellbore through the longitudinal bore of the drill string; inserting the drill string, the directional borehole drilling assembly and the drilling assembly into the wellbore and driving the drilling assembly to operate to form a wellbore to a diameter greater than the diameter of the drill string; operating the rotary steerable tool to drive the drilling assembly laterally relative to the wellbore; removing at least the primary bit and the hole enlargement tool of the drilling assembly from the distal end of the drill string and moving the at least the primary bit and the hole enlargement tool of the drilling assembly with at least a part of the directional borehole drilling assembly connected thereto out of the wellbore through the drill string without removing the drill string from the wellbore; and leaving the drill string in the wellbore.

23. The method of claim 22 wherein the hole enlargement tool is an underreamer including radially expandable and retractable underreamer arms and the method comprises retracting the underreamer arms prior to moving the drilling assembly through the drill string.

24. The method of claim 22 wherein after moving the at least the primary bit and the hole enlargement tool of the drilling assembly with at least a part of the directional borehole drilling assembly connected thereto out of the wellbore through the drill string, the method further comprises replacing the at least the primary bit and the hole enlargement tool of the drilling assembly on the distal end of the drill string and operating the drilling assembly to continue formation of the wellbore.

25. The method of claim 24 further comprising replacing the at least a part of the directional borehole drilling assembly when replacing the at least the primary bit and the hole enlargement tool.

26. An apparatus for drilling a wellbore in an earth formation comprising: a drill string having a longitudinal bore therethrough; a drilling assembly connected at the lower end of the drill string, the drilling assembly selected to be operable to form a borehole and including a primary bit and a hole enlargement tool, the hole enlargement tool acting to enlarge the wellbore diameter behind the primary bit and the primary bit and the hole enlargement tool being retrievable through the longitudinal bore of the drill string; and a directional borehole drilling assembly connected between the primary bit and the hole enlargement tool and including a rotary steerable tool for applying a force to the drilling assembly to drive it laterally relative to the wellbore, the directional borehole drilling assembly selected at least in part to be retrievable through the longitudinal bore of the drill string.

27. The apparatus for drilling a wellbore of claim 26 wherein the hole enlargement tool is extendable and retractable relative to the primary bit.

28. The apparatus for drilling a wellbore of claim 26 wherein the primary bit and the hole enlargement tool are replaceable on the lower end of the drill string by running through the longitudinal bore of the drill string and once replaced are operable with the drill string to continue to form a borehole.

29. The apparatus for drilling a wellbore of claim 28 wherein the directional borehole drilling assembly is selected at least in part to be replaceable through the longitudinal bore of the drill string.

30. An apparatus for drilling a wellbore in an earth formation comprising: a drill string having a longitudinal bore therethrough; and an assembly including a primary bit at its first end, an underreamer adjacent its opposite end, the underreamer including radially expandable and retractable underreamer arms operable to enlarge the wellbore diameter behind the primary bit, and a directional borehole drilling assembly positioned between the primary bit and the underreamer, the assembly being releasably connectable at the lower end of the drill string to be operable to form a directionally selected borehole and being retrievable through the longitudinal bore of the drill string.

31. The apparatus for drilling a wellbore of claim 30 wherein the assembly is replaceable on the lower end of the drill string by running through the longitudinal bore of the drill string and once replaced is operable with the drill string to continue to form the borehole.

32. The apparatus for drilling a wellbore of claim 30 wherein the opposite end of the assembly is connectable at the lower end of the drill string and the assembly is formed such that the underreamer and primary bit rotate with drill string and the directional borehole drilling assembly includes a rotary steerable tool.

33. A method for directionally drilling a well with a well casing as an elongated tubular drill string and a drilling assembly retrievable from the lower distal end of the drill string without withdrawing the drill string from a wellbore being formed by the drilling assembly, the method comprising: providing the casing as the drill string; providing an assembly including a primary bit at its first end, an underreamer adjacent its opposite end, the underreamer including radially expandable and retractable underreamer arms operable to enlarge the wellbore diameter behind the primary bit, and a directional borehole drilling assembly positioned between the primary bit and the underreamer, the assembly being operable to form a directionally selected borehole and being moveable through the longitudinal bore of the drill string; connecting the assembly at its opposite end to the distal end of the drill string such that the underreamer, directional borehole drilling assembly and primary bit extend out below the drill string; inserting the drill string and the assembly into the wellbore and operating the drilling assembly to form a wellbore to a diameter greater than the diameter of the drill string; operating the directional borehole drilling assembly to select the direction of the wellbore; removing the assembly from the distal end of the drill string and moving the assembly out of the wellbore through the drill string without removing the drill string from the wellbore; and leaving the drill string in the wellbore.

34. The method of claim 33 wherein the opposite end of the assembly is connected at the lower end of the drill string such that the underreamer and the primary bit rotate with the drill string and the directional borehole drilling assembly includes a rotary steerable tool.

35. The method of claim 33 wherein after moving the assembly out of the wellbore through the drill string, the method further comprises replacing the assembly on the distal end of the drill string and operating the assembly to continue formation of the wellbore.

* * * * *

UNITED STATES PATENT AND TRADEMARK OFFICE

CERTIFICATE OF CORRECTION

PATENT NO. : 6,705,413 B1
DATED : March 16, 2004
INVENTOR(S) : Robert M. Tessari It is certified that error appears in the above-identified patent and that said Letters Patent is hereby corrected as shown below:

Column 8,
Line 38, delete “composing” and insert -- comprising --

Signed and Sealed this

Twenty-fifth Day of May, 2004

JON W. DUDAS
*Acting Director of the United States Patent and Trademark Office*